United States Patent [19]

Kideys

[11] Patent Number: 4,632,066

[45] Date of Patent: Dec. 30, 1986

[54] MULTIPLE SEGMENT GAS WATER HEATER AND MULTIPLE SEGMENT GAS WATER HEATER WITH WATER JACKET

[76] Inventor: Fazil F. Kideys, 17 Agate Rd., E. Brunswick, N.J. 08816

[21] Appl. No.: 611,355

[22] Filed: Jun. 7, 1985

[51] Int. Cl.[4] ..... F22B 23/06

[52] U.S. Cl. ..... 122/13 R; 122/20 B; 122/16; 122/209 R; 122/17

[58] Field of Search ..... 122/20 B, 13 R, 16, 122/17, 19, 209 R, 230, 209 A

[56] References Cited

U.S. PATENT DOCUMENTS

| | | | |
|---|---|---|---|
| 477,470 | 6/1892 | Thatcher | 122/209 R |
| 693,870 | 2/1902 | Kuen et al. | 122/209 R |
| 1,670,665 | 5/1928 | McClung | 122/13 R |
| 1,912,834 | 6/1933 | Geyer | 122/16 |
| 1,961,723 | 6/1934 | Wilson | 122/17 |
| 2,420,935 | 5/1947 | D'Aquin | 122/16 |
| 3,063,138 | 11/1962 | Vandenburgh | 122/17 |
| 3,065,745 | 11/1962 | Ericsson | 122/17 |
| 3,269,382 | 8/1966 | Ronan | 122/17 |
| 3,707,142 | 12/1972 | Kobayashi | 122/17 |
| 4,257,355 | 3/1981 | Cook | 122/17 |
| 4,275,687 | 6/1981 | Sasaki | 122/20 B |
| 4,357,909 | 11/1982 | Kogoshima | 122/17 |
| 4,366,778 | 1/1983 | Charrier et al. | 122/17 |
| 4,381,819 | 5/1983 | Paolino | 237/55 |
| 4,403,574 | 9/1983 | Free | 122/209 R |
| 4,412,509 | 11/1983 | Black | 122/17 |
| 4,438,728 | 3/1984 | Fracaro | 122/17 |
| 4,449,485 | 5/1984 | Tan | 122/209 R |
| 4,484,564 | 11/1984 | Erickson | 122/20 B |
| 4,503,810 | 3/1985 | Fujishita et al. | 122/13 R |

*Primary Examiner*—Henry C. Yuen

[57] ABSTRACT

The Multiple Segments Gas Water Heater with Water Jacket is an invention to increase, by several times, the efficiency of a gas water heater presently used in homes. This device prevents energy loss of hot air escaping to the atmosphere, coming from combustion of fuel. This is fulfilled by increasing heat exchange surface area in the heater by segmentation of the water tank and by preheating the cold water in the water jacket placed around the segmented water tank composed of multiple heat exchanger segments.

3 Claims, 6 Drawing Figures

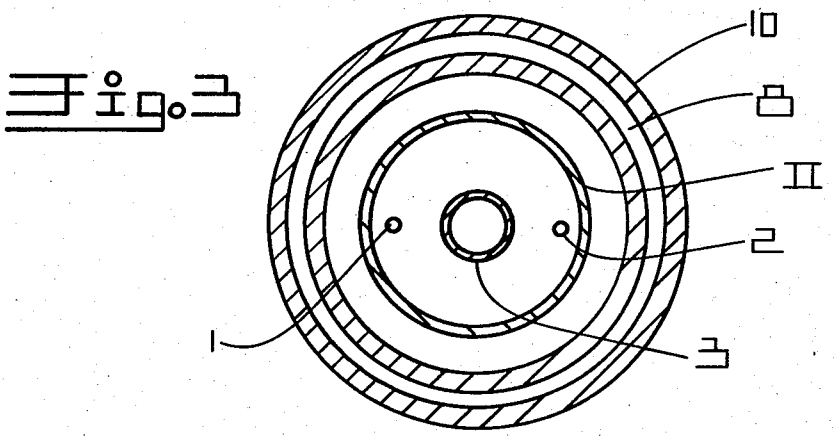
Fig. 3
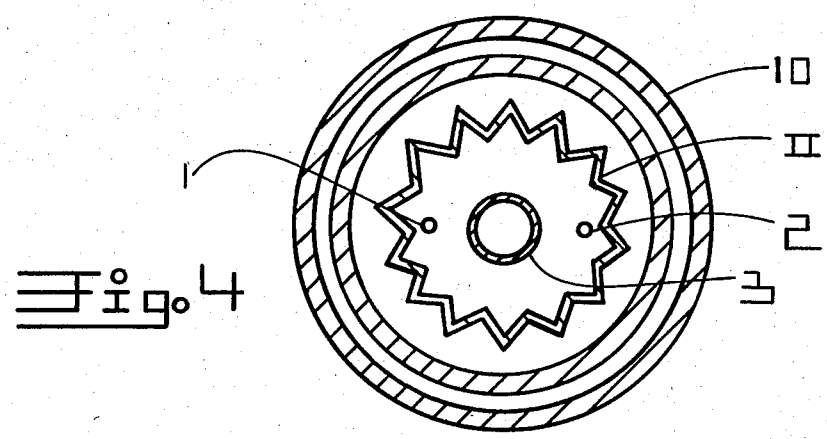
Fig. 4
Fig. 5
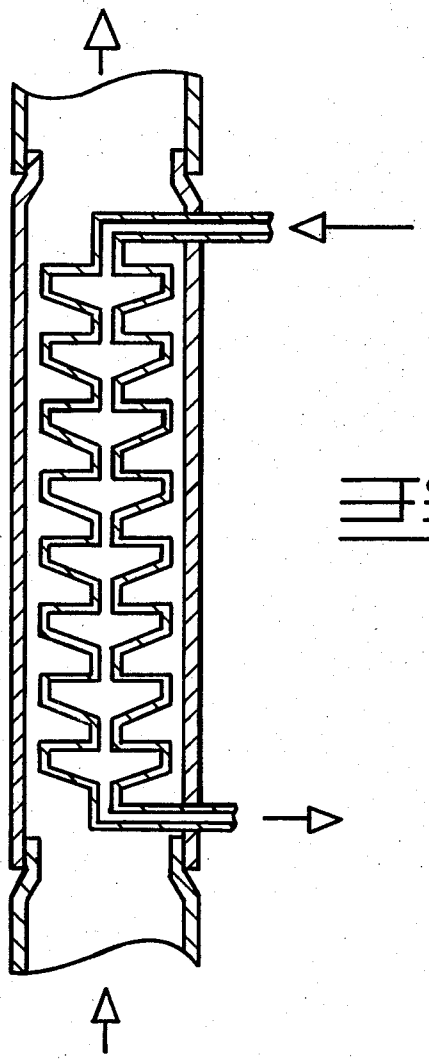

MULTIPLE SEGMENT GAS WATER HEATER AND MULTIPLE SEGMENT GAS WATER HEATER WITH WATER JACKET

FIELD OF INVENTION

This device is applicable to gas water heaters to save energy by preventing the escape of hot gas before most of its heat is captured by the water that is to be heated.

DESCRIPTION OF THE PRIOR ART

The gas water heaters, generally used in a household now, are made of a perpendicular cylinder as water tank with a flue pipe in the center communicating combustion chamber to chimney. In this device heat exchange surface is exceedingly limited, merely to the area of water tank having contact with central flue. Consequently, very great portion of energy of the hot gas coming from combustion chamber is lost to the atmosphere through the chimney. The Multiple Segments Gas Water Heater with Water Jacket is designed to capture the heat of hot gas before it leaves the heater. This is done by segmentation of water tank into individual heat exchangers. Hot air created by burning fuel is exposed to circulate around and in center of each heat exchanger segments, providing a heat exchange surface area several times greater than the above mentioned regular household water heater. Additionally a water jacket, an annular cylinder, containing cold water and surrounding heat exchanger segments, increases heat exchanger surface area as much as segmentation. Water jacket also preserves heat by separating the inner section of heater from outside atmosphere with a cold water layer which is supplied in. With this brief outline we can conclude that Multiple Segments Gas Water Heater with Water Jacket is a highly efficient energy saving water heater, with relatively simple construction requiring not too many pieces and materials.

SUMMARY OF THE INVENTION

The problem with presently used household gas water heaters is the low efficiency. This problem is solved by increasing the heat exchange surface area by segmentation of water tank into several heat exchanger segments and by encasing the segments with a cold water jacket which additionally increases heat exchange surface area and insulates inner section of heater from outside with cold water itself that preheats. The advantage of this invention is substantial energy conservation and amenability of relatively simple construction.

BRIEF DESCRIPTION OF THE DRAWING

FIG. 3 is cross section view at the level of x—x plane of FIG. 2.

FIG. 4 is cross section view of a heat exchanger segment of which wall is vertically corrugated.

FIG. 5 is about a segmented tube water heat collector. It is a plane section of a segmented tube inserted into a stack of chimney.

Figure 1A:
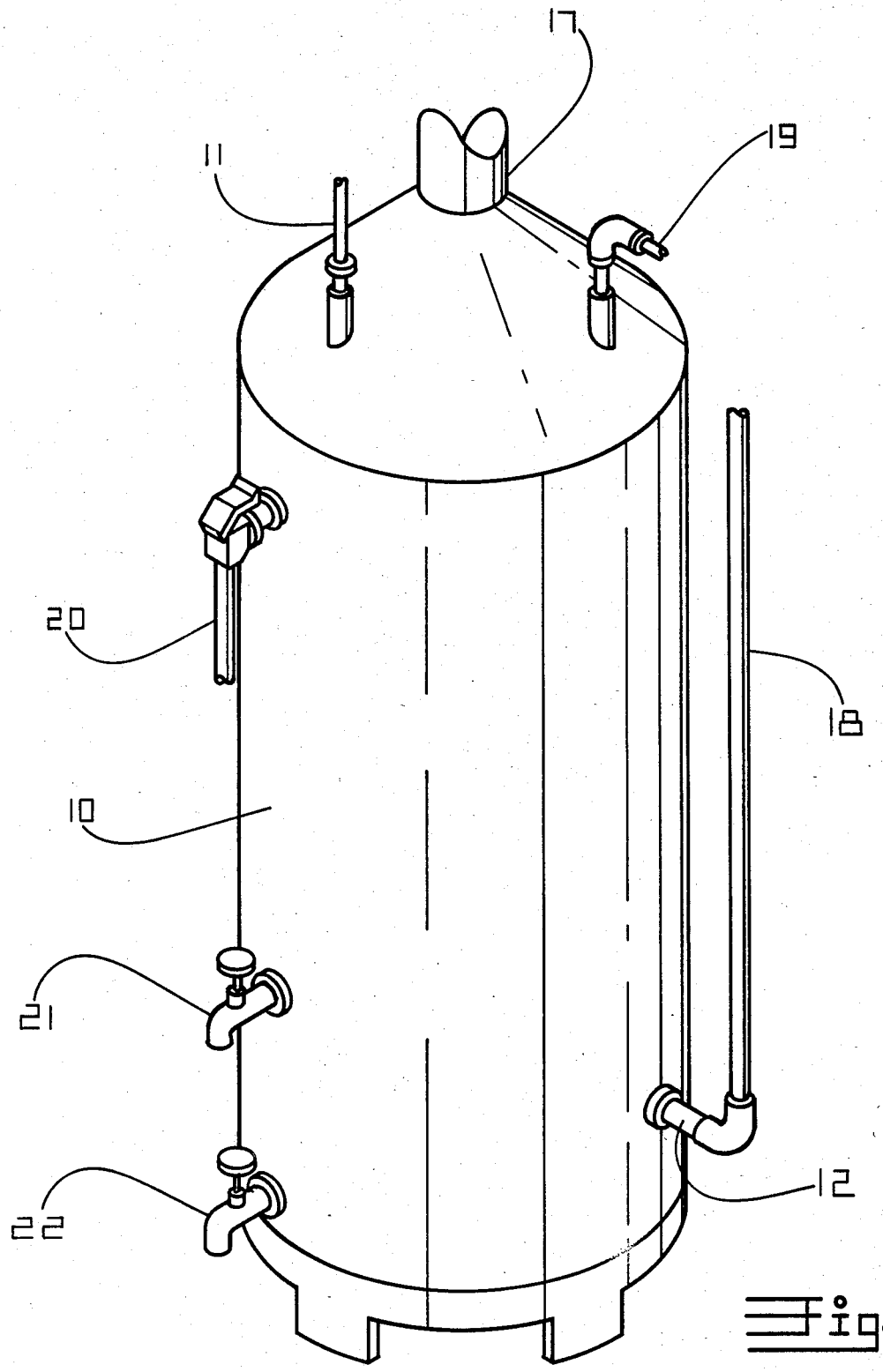
FIGS. 1*a* and 1*b* show a frontal view (a) and a frontal perspective view with dissection of parts of water jacket and heat exchanger segments (b) to show inner structure of Multiple Segments Gas Water Heater with Water Jacket.
Figure 1B:
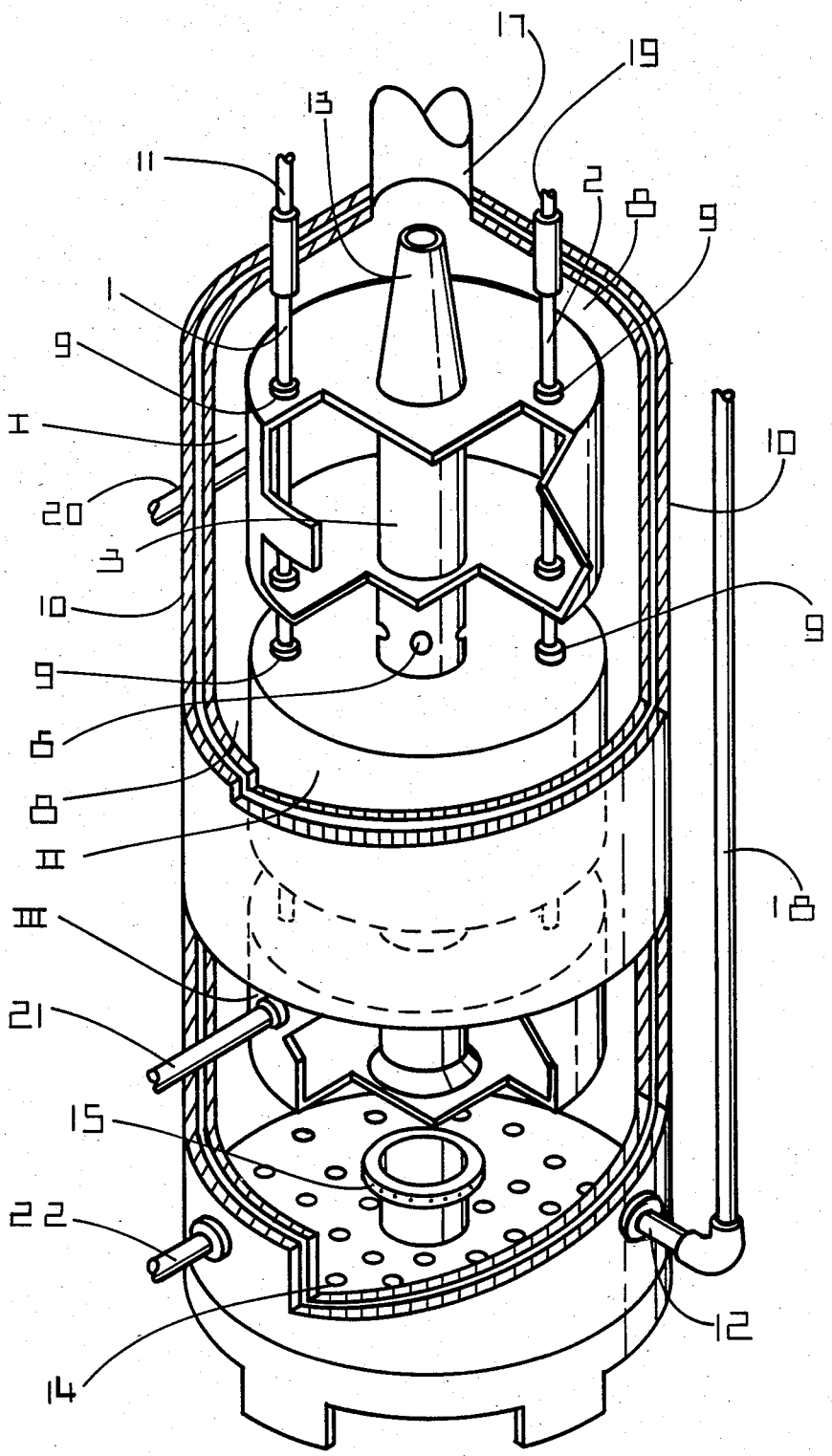
Figure 2:
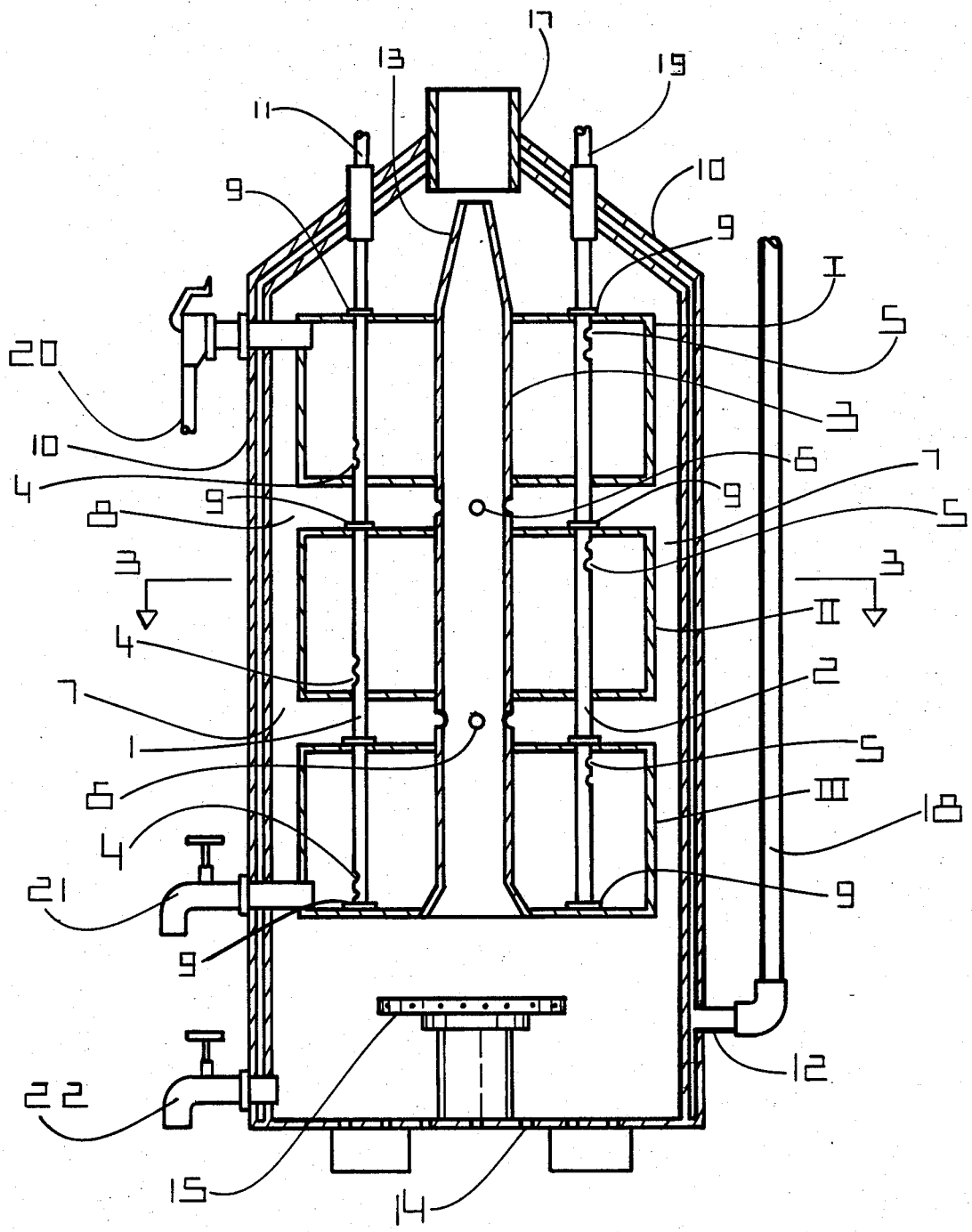
FIG. 2 is frontal plane view.

The description of the device is done in accompanying legend by the plane and cross section views of FIG. 1, 2 and 3. Components' numbers on the figure are the same as of paragraphs of the legend. Component number are usually repeated after component name, in the legend, as follows:

DESCRIPTION OF THE DRAWINGS

The construction of Multiple Segments Gas Water Heater with Water Jacket is basically as simple as presently used ones. The main difference is the segmented tank. Segmented tank is encased in the shell of heater. The shell of the heater is replaced by the water jacket which surrounds combustion chamber and segmented tank. Each segment of the tank is an individual heat exchanger segment. The inlet, outlet pipes of water and central flue duct of exhaust hot gas serve as supportive frame for the heat exchanger segments beside being passage way for water and hot gases. In the following paragraphs these are explained in conjunction with Figures and the numbers which correspond also to paragraphs' numbers.

I. Top segment of a triple segments water tank where preheated cold water pipe 1 enters and hot water outlet pipe 2 exists.

II. Intermediary segment which is connected to top I and bottom III segments through inlet 1 and outlet 2 water pipes and central flue pipe 3.

III. Bottom segment, it stands above the combustion chamber 11 and similarly connected to the intermediary segment II.

With the segmentation of water tank to multiple heat exchanger segments heat absorbing surface area is several times increased, which is the main purpose of this project to increase efficiency by increasing heat exchange surface area.

1. Preheated cold water inlet pipe 1 is traveled from the upper segment I to bottom segment III through intermediary segment II. It has perforations as diffuser orifices 4 on its portions within each segment. The orifices 4 will distribute cold water into each segment evenly with the same water pressure.

2. Heated water outlet pipe 2 is traveled from bottom segment III to top segment I through intermediary segment II. It has perforations as outlet orifices 5 on its portions within each segment to let the heated water be taken out evenly from each segment while preheated cold water from water jacket is filling the segments through water inlet pipe's diffuser orifices 4.

3. Central flue pipe 3 communicates combustion chamber 15 to chimney 17; it has ventholes perforations 6 in its portions between two segments to communicate with horizontal hot air spaces 7 between segments, and peripheral hot air spaces 8 between segments and water jacket 10. Central flue pipe, at its top end at the level of chimney, has a constricted outlet to form a venturi 13 which will induce hot gas flow from peripheral spaces 8 when exhaust gas flow in it is increased.

4. Perforation of water inlet pipe 1 as diffuser orifices located inside of each segment at lower level.

5. Perforation of water outlet pipe 2 as outlet orifices located inside of each segment at upper level. These perforations are for in and out water movement and pressure distribution in all segments and make a continuum of all segments as one water tank. The levels and directions of diffuser and outlet orifices of the water pipes are arranged in opposed positions to cause a turbulent water flow within the segments to prevent stratification and provide good admixture of water for an even temperature.

6. Perforations as ventholes 6 of central flue pipe 3. These ventholes are located between two segments communicating peripheral hot gas space 8 through horizontal hot gas space 7. They serve as hot air exchange passage between central flue 3 and peripheral hot gas spaces making them a continuum altogether.

7. Intersegmentar hot air spaces 7 are horizontal spaces between two segments 7.

8. Peripheral hot air spaces between segments and water jacket. Peripheral space is a continuation of combustion chamber space 15 and is communicated with central flue space 3 through ventholes 6 and horizontal spaces 7. Through these spaces heat exchange between hot exhaust gases and water occurs not only from central flue but also from sides, from bottom and top of each segment. Even distribution of hot exhaust gas flow is maintained with the help of venturi 13.

9. Junctions of segments with central flue pipe 3 and with water pipes 1–2 are done by pipe fitting or by welding.

10. The shell of the heater is replaced by the water jacket 10. This is an annular cylinder, containing incoming cold water which is supplied by cold water supply tube 12. Cold water is prestored and preheated first in water jacket plenum 10 which serves as a blanket around the heater, eliminating the need for insulation.

11. Exit of preheated water from water jacket is done by a connecting tube 11 which connects water jacket plenum 10 to heat exchanger segments' water inlet pipe 1 at the top, in opposing side to cold water supply tube 12 entrance.

12. Cold water supply tube 12 carries water into water jacket 10 from water supply pipe, while connecting tube 11 carries preheated water out from water jacket into heat exchanger segments through water inlet pipe 1.

13. Venturi, it is formed by constricted outlet of central flue pipe at the level of chimney. According to Venturi principle, excess gas flow within constricted end will cause negative pressure around it, that will draw gases from peripheral spaces 8 into chimney until an equilibrium is occurred in gas flow in flue space 3 and peripheral spaces 8.

14. Ventholes for entry of combustion air.

15. Combustion chamber where burner and heat control system is placed.

16. The top cover wall of heater, is formed by extension of water jacket. It has apertures for the passage of chimney and water pipes.

17. Chimney duct of heater, at its bottom end it enclose the constricted outlet of central flue pipe forming a venturi 10.

18. Cold water supply pipe 18 is connected to cold water supply tube at the bottom side of water jacket where cold water is jet sprayed toward the bottom of water jacket.

19. Hot water pipe, it is connected to heated water outlet pipe on the top of heater.

CORRUGATED HEAT EXCHANGER SURFACES (A) AND SEGMENTED TUBE AS HEAT COLLECTOR (B)

A. Corrugated Heat Exchanger Surfaces

In addition to the above described MULTIPLE SEGMENTS GAS WATER HEATER WITH WATER JACKET, inventor wants to claim CORRUGATED HEAT EXCHANGER SURFACE AREA—and a HEAT COLLECTOR made of a segmented tube as energy savers.

FIG. 4 showing cross section of a device wherein heat exchanger segment's surface is corrugated vertically for further increase of heat transfer surface area. Corrugation is also applicable to inner wall of water jacket which could be made in vertical as well as in horizontal and in helical manner. Corrugation of heat exchange surface area of heat exchanger segments and inner wall of water jacket will necessarily increase the cost and weight of the device. On the other hand, highly augmented efficiency of corrugated device will provide to make smaller device that could be placed on kitchen's or shower room's wall for instant water heating. In this case the shape of device in cross section, will be elliptical rather than cylindrical to fit against a wall.

B. Segmented Tube As Heat Collector

Segmentation being an idea to increase heat transfer surface area it may be applicable to a segmented tube. Cold water enters in one end. Before it exits from other end, heat transfer will occur to water through the wall of segmented tube from hot gases passing around it. FIG. 5 shows a segmented tube placed in a stack of chimney. Direction of water flow in the tube is opposed to direction of hot exhaust gases flow within the stack. Segmented tube in a piece of stack becomes an individual heat collector. Like a piece of stack it is easily incorporated to any chimney. Here also corrugation is applicable. This gives a star shape to segment of the tube in cross section that increases heat transfer surface of tube and provides more space to hot exhaust gases to pass through.

I claim:

1. A gas water heater having (A) an annular water jacket surrounding a combustion chamber below and a vertically stacked, spaced multiple heat exchanger segments above, said multiple heat exchanger segments being spaced from said water jacket, (B) a conical top wall, in extension of the water jacket, having a central opening forming an exhaust gas passage, (C) a chimney being connected to said central opening of said top wall, (D) each heat exchanger segment having a perforated water inlet pipe and a perforated water outlet pipe within said heat exchanger segments, said inlet and outlet pipes being vertically connected to other heat exchanger segments through water pipe, (E) each heat exchanger segment having a central opening to receive a perforated exhaust flue pipe communicating to said combustion chamber and extending into said chimney, said perforations of the flue pipe being exposed between said heat exchanger segments in communication with space between heat exchanger segments and water jacket, said exhaust flue pipe having a constricted outlet within said chimney to form a venturi whereby additional exhaust gases can be induced into said chimney from the spaces between said heat exchanger segment and water jacket, (F) an incoming cold water supply tube being connected at the top portion of the water jacket for preheating, a hot water pressure relief pipe being connected to the uppermost heat exchanger segment, (G) a heated water outlet tube being connected to said perforated outlet water pipe of the uppermost exchanger segment, and (H) a connecting tube making connection between said perforated inlet pipe of the uppermost heat exchanger segment and top portion of the water jacket whereby incoming water being preheated and circulated from water jacket to said connecting tube and into said heat exchanger segments.

2. A gas water heater according to claim 1 wherein each heat exchanger segment and inner wall of water jacket having corrugated heat exchange surfaces.

3. A gas water heater according to claim 1 having a chimney duct that can be equipped with a segmented tube, as heat collector, placed inside of said chimney duct, exposed to outgoing exhaust gases.

* * * * *